US006347795B1

(12) United States Patent
De Leljer

(10) Patent No.: US 6,347,795 B1
(45) Date of Patent: Feb. 19, 2002

(54) GAMING MACHINE HAVING A REEL ON WHICH, ALONG A CIRCUMFERENCE, SYMBOLS ARE APPLIED

(75) Inventor: Antonius Laurentius Gerardus Maria De Leljer, Vught (NL)

(73) Assignee: Orion Casino Technology B.V., Bergen Op Zoom (NL)

( * ) Notice: Subject to any disclaimer, the term of this patent is extended or adjusted under 35 U.S.C. 154(b) by 0 days.

(21) Appl. No.: 09/573,660

(22) Filed: May 18, 2000

Related U.S. Application Data

(63) Continuation of application No. PCT/NL97/00636, filed on Nov. 20, 1997.

(51) Int. Cl.[7] ..... G07F 17/34; A63F 5/04

(52) U.S. Cl. ..... 273/143 R; 463/20; 463/21

(58) Field of Search ..... 273/143 R, 138.1, 273/138.2; 463/16, 20, 21, 22; 318/696, 685

(56) References Cited

U.S. PATENT DOCUMENTS

| | | | | |
|---|---|---|---|---|
| 3,918,716 A | | 11/1975 | Nonaka et al. | |
| 4,095,795 A | | 6/1978 | Saxton et al. | |
| 4,261,571 A | | 4/1981 | Ito | |
| 4,299,388 A | | 11/1981 | Resch et al. | |
| 4,448,419 A | | 5/1984 | Telnaes | |
| 4,711,451 A | | 12/1987 | Pajak et al. | |
| 5,102,134 A | | 4/1992 | Smyth | |
| 5,154,421 A | | 10/1992 | Hamano | |
| 5,219,167 A | | 6/1993 | Hamano | |
| 5,423,540 A | | 6/1995 | Taxon | |
| 5,785,595 A | * | 7/1998 | Gauselmann | 463/20 |
| 5,839,957 A | * | 11/1998 | Schneider et al. | 463/20 |
| 6,003,867 A | * | 12/1999 | Rodesch et al. | 273/143 R |

FOREIGN PATENT DOCUMENTS

| | | |
|---|---|---|
| EP | 0 338 743 A2 | 10/1989 |
| GB | 1 550 732 | 8/1979 |
| GB | 2 193 025 | 1/1988 |

* cited by examiner

*Primary Examiner*—Jessica J. Harrison
(74) *Attorney, Agent, or Firm*—Stroock & Stroock & Lavan LLP

(57) ABSTRACT

A gaming machine, comprising a reel, of which a circumferential surface is divided into a number of fields, each suitable for bearing a symbol (which is also understood to include a blank), a microstep drive unit, which is suitable for positioning the reel within each field in a number of angle positions and maintaining it therein, a memory with a table whose locations contain enabled stop positions, and random generator means which generate a random number within the address range of the table, for addressing the table therewith, in order to read out the enabled stop position stored in the addressed memory location, and in order to rotate the reel to the read-out enabled stop position.

4 Claims, 1 Drawing Sheet

GAMING MACHINE HAVING A REEL ON WHICH, ALONG A CIRCUMFERENCE, SYMBOLS ARE APPLIED

CROSS-REFERENCE TO RELATED APPLICATIONS

This is a continuation application of PCT/NL97/00636 filed Nov. 20, 1997, now PCT Publication WO99/27506.

FIELD OF THE INVENTION

The invention relates to a gaming machine comprising a reel of which a circumferential surface is divided in a number of fields which each bear a symbol from several symbols, which may include a blank, drive means for rotating the reel, memory means for storing data representing allowed rotational stop positions of the reel where the reel is allowed to stop, the number of allowed stop positions being greater than said number of fields, random number generator means for randomly generating an address of a location of said memory means containing data representing an allowed stop position and stop means for controlling the drive means to stop rotation of the reel opposite a winning line at a rotational stop position which corresponds to said randomly generated memory means address.

BACKGROUND OF THE INVENTION

U.S. Pat. No. 4,711,451 discloses three types of prior art gaming machines, i.e. a standard gaming machine, a multiple stop gaming machine and a virtual reel gaming machine.

A standard gaming machine typically employs reels which have one stop position for each symbol (or indicia) on the reel, each stop position having one random number associated with it. To stop a reel in a standard gaming machine, a random number is generated and the reel stopped at the stop position associated with the random number.

A multiple stop gaming machine employs reels having multiple stop positions for many of the symbols on the reel and fewer to one stop position for higher paying symbols. Each stop position has only one random number associated with it. To stop the reel a random number is generated and the reel is stopped at the stop position associated with the random number. Because of the different numbers of stop positions for the symbols the odds of winning can be differentiated.

A virtual reel gaming machine employs reels typically having one stop position associated with each symbol and a number of stop positions have multiple random numbers associated with them. A gaming machine of this type is disclosed by U.S. Pat. No. 4,448,419.

With all said prior art machines a random number is generated and the associated reel is stopped at the stop position associated with the generated random number.

The gaming machine proposed by U.S. Pat. No. 4,711,451 includes a number of rotating symbol bearing reels, each reel having several stop positions associated with each symbol on the reel. A specially designed reel mapping scheme allows one standard reel stop control software routine to control the stopping of the reels when the machine is operated as standard gaming machine, multiple stop gaming machine or a virtual reel gaming machine. According to said document, to provide gaming machines to play one out of a standard type game, multiple stop type game or virtual reel type game, gaming machine manufacturers had to develop different reel stop controls including different software routines for each game type, while the software development for the different types of games was considered extremely costly. Therefore, to reduce costs, the machine with selectable play type using one standard reel stop control software routine was proposed.

With the combined gaming machine disclosed by U.S. Pat. No. 4,711,451, for a plurality of reels of the machine a single software routine is used for each of the reels in turn. To make it possible to have the combined machine operate in accordance with one of said prior art individual machines, the combined machine comprises three memory arrays, i.e. a mapping index array, a reel stop map and a single reel map. To have the combined machine to operate according to a multiple stop gaming machine locations of the mapping index array contain a sequence of offset values of indexes referring to physical reel stop positions where the reel is allowed to stop. Said memory locations containing indexes for allowed reel stop positions form a sequence of memory locations without intermediate memory locations of unallowed stop positions. With a sequence of k allowed stop positions a random generator has a random number range of 0–(k–1), each referring to a respective memory location of the mapping index array containing said indexes. After having generated a random number the index of the memory location addressed by the random number is read. From the read out index addresses are calculated for a memory location of each of the reel stop map and the symbol reel map. An addressed memory location of the reel stop map contains stop position data for driving means where the reel must stop. An addressed location of the symbol reel map contains symbol data of a specific symbol from P+1 different symbols.

To have the combined gaming machine operated as a standard gaming machine or a virtual gaming machine the contents of the mapping index array must be altered and by doing so the addressing schemes for the reel stop map and the symbol reel map are changed. Under all circumstances the reel stop map must comprise a number of memory locations with equals the number P+1 of symbols times the number n of possible stop positions per symbol. The symbol reel map must always comprise P+1 locations for P symbols. The mapping index array must have the same number of memory locations at the maximum as the reel stop map has, which is the case when operating the machine as a multiple stop gaming machine.

To make it possible for the combined gaming machine to operate according to any of said individual gaming machines the reel stop map must have memory locations for all possible physical stop positions, the number of symbols must be maintained under all circumstances and all symbols must have identical circumferential dimensions under all circumstances. Since the same software routine is used for several reels, the number of symbols for all reels must be identical. In addition, a random number generator must be designed to have a number range which equals the number of allowed stop positions. Therefore, for any change of the number of allowed stop positions the random number generator must be changed too and must be calibrated again, which is very time consuming and costly.

With the combined gaming machine using said one standard software routine, although the number of stop positions associated with each symbol on a reel could be any number, said number is considered to be rather small in practice in view of the requirement of reducing costs mentioned in the document, where a greater number of stop positions would increase the hardware and the complexity of mapping schemes for said one standard software routine. As a result said combined gaming machine is not suitable for having a reel stopped with a very high price paying symbol opposite a winning line with a very small probability.

EP-A-0338743 discloses, in its prior art part, a multiple stop gaming machine having two reel stops located very close together for certain symbols on the reels and one stop for other symbols. The symbols having two reel stops will have twice the probability of being stopped in a winning position, thus effectively decreasing the odds that a symbol with only one reel stop will appear in the winning positing. It is not substantiated what is meant by "very close together", how many reel stops are associated with each symbol field where the reel is allowed to stop or not, and how a distribution of allowed stop positions among unallowed stop positions must be.

SUMMARY OF THE INVENTION

It is an object of the invention to provide a multiple stop gaming machine which does not have said drawbacks.

To this end, the invention provides a gaming machine comprising a reel of which a circumferential surface is divided in a number of fields which each bear a symbol from several symbols, which may include a blank, drive means for rotating the reel, memory means for storing data representing allowed rotational stop positions of the reel where the reel is allowed to stop, the number of allowed stop positions being greater than said number of fields, random number generator means for randomly generating an address of a location of said memory means containing data representing an allowed stop position and stop means for controlling the drive means to stop rotation of the reel opposite a winning line at a rotational stop position which corresponds to said randomly generated memory means address, wherein adjacent rotational stop positions are less than 0,1° apart from each other and for each field all allowed stop positions are located within an arc of 2°.

The stepping motor can provide a very great number, which number may be over 10.000, of rotational stop positions of the reel. By allowing only those stop positions to actually stop the reel which are difficult to distinguish with respect to the winning line by the naked eye, if opposite the associated field at stand still of the reel, the gaming machine appears to the player as a standard gaming machine or virtual reel gaming machine but with the provision of showing few symbols with a much smaller chance for higher prices.

BRIEF DESCRIPTION OF THE DRAWINGS

Other features and advantages of the invention will emerge from the explanation of an embodiment of the invention which follows with reference to the drawings, in which.

DESCRIPTION OF THE PREFERRED EMBODIMENT

Figure 1:
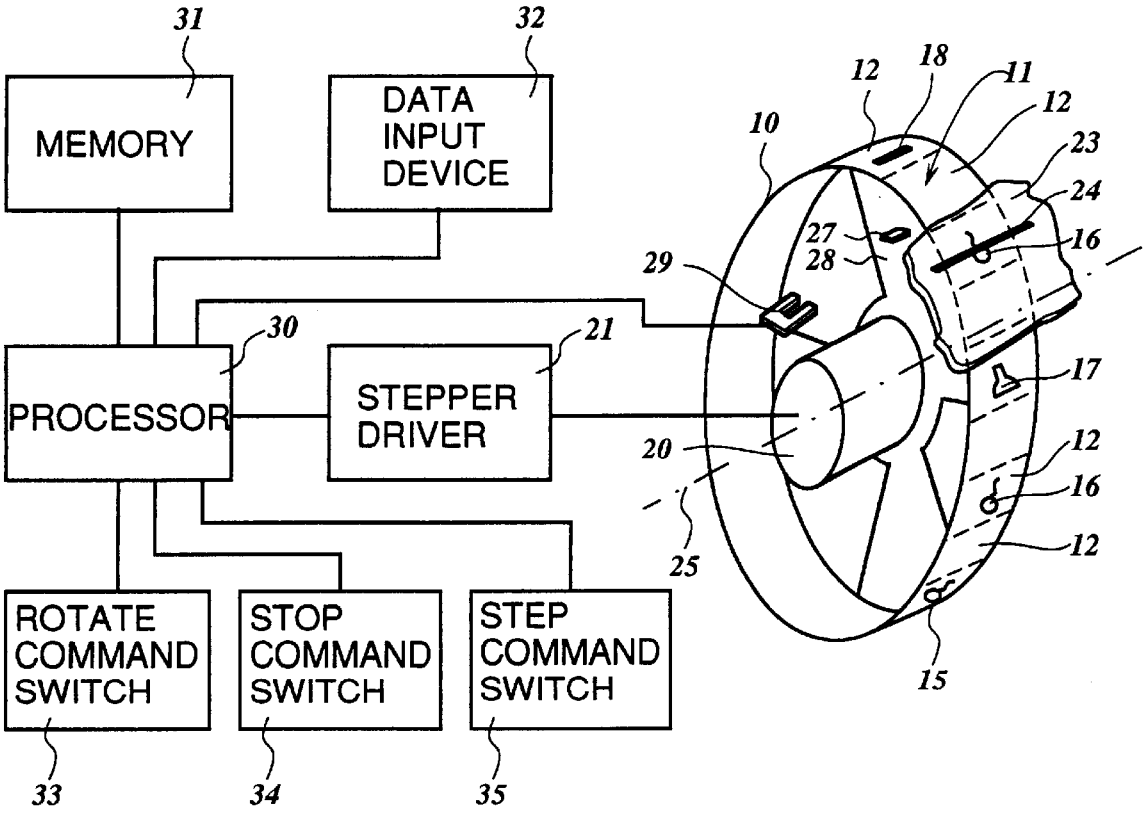
FIG. 1 shows a diagram of a gaming machine according to the invention.

The gaming machine shown diagrammatically in FIG. 1 comprises a reel 10 with a circumferential surface 11 which is divided into a number of fields 12. A symbol, such as a pear 15, a cherry 16, a bell 17 and a bar 18, can be placed in each field 12. In this description an empty field 12 (blank) is also regarded as a symbol, namely as something of significance.

The reel 10 is connected to a shaft of a stepping motor 20. The stepping motor 20 is controlled by a drive circuit 21. The drive circuit 21 and the stepping motor 20 are suitable for driving the reel 10 to and maintaining it in more angle positions (microsteps) than the number of poles or double the number of poles of said stepping motor. For this purpose, use can be made of a geared transmission (not shown) between the motor 20 and the reel 10, in such a way that the motor 20 performs several revolutions for one revolution of the reel 10. However, the stepping motor 20 and the drive circuit 21 preferably form a microstep drive, in which, with a suitable electrical control by the drive circuit 21, the rotor of the stepping motor 20 can assume a relatively large number of stable angle positions between adjacent poles. Such a microstep drive mode is described in SGS-Thomson Microelectronics, "data on disc", compact disc CDDATASH197, 1st edition 1997. By using a microstep drive there is no problem with mechanical play, and the maximum achievable speed of revolution of the reel 10 can be higher.

A window panel 23 of an otherwise closed console (not shown) is fitted opposite a part of the circumferential surface 11 of the reel 10. At least one field 12 of the reel 10 is visible through the window panel 23. The window panel 23 has a marking, such as a "pay-out line" 24 parallel to the axis of rotation 25 of the reel 10 and the motor 20.

On the reel 10, for example on a "spoke" 27 thereof, a mark is placed, for example in the form of a projection or flag 28, which can pass through a slot of, for example, an optical bridge detector 29 during the rotation of the reel l0.

The drive circuit 21 is fed by a processor 30, which is connected to a memory 31, a data input device 32, a rotate command switch 33, a stop command switch 34 and a step command switch 35.

When the rotate command switch 33 or the stop command switch 34 is actuated by a player of the machine or by other means inside the machine, the processor 30 controls the microstep drive unit 20, 21 for rotating or stopping the reel 10 respectively.

The processor 30 operates with a program, the instructions and corresponding data of which are stored in the memory 31 or in a separate memory. A subroutine of the program operates, as known per se, so as to generate one or more random numbers. Of course, instead of such programmatic random generator means, a separate random generator (means), linked to the processor 30, can be connected.

Although only one reel 10 is shown in FIG. 1, a gaming machine will generally have several such reels, each having its own microstep drive unit 20, 21 and a step command switch 35. Depending on the symbol or the combination of symbols visible beneath the pay-out lines 24 of the reels 10, a pay-out or no pay-out is made to a player of the machine.

The operation of the gaming machine shown in FIG. 1 will be explained below with reference to FIG. 2.

As an example, it is assumed that the circumferential surface 11 of the reel 10 is divided into 20 fields and that the microstep drive unit 20, 21 can position and maintain the reel in 10,000 different angle positions. Each angle position or each step of the reel 10 then corresponds to an angle or arc of 360°/10,000=0.036°. Further, in this example each field has a range of 10,000/20=500 angle positions or steps or possible stop positions of the reel 10.

Figure 2:
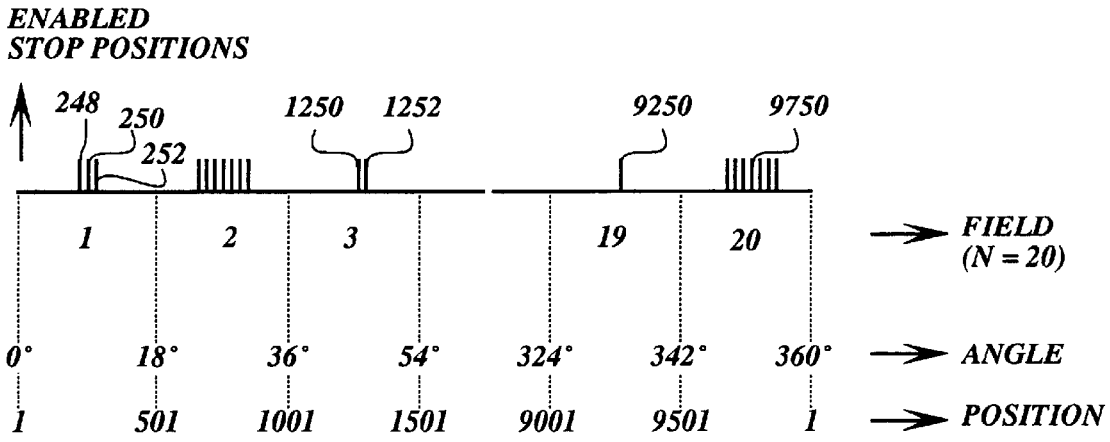
FIG. 2 shows a chart for explaining the operation of the gaming machine of FIG. 1.

In the example of FIG. 2, three angle positions out of the available 500 angle positions of the field 1 where the reel 10 may come to a standstill are allocated to the first field. These three enabled stop positions could be distributed randomly within the range of 500 positions. However, these positions are preferably selected close together, so that a difference in the distance from, for example, the centre of the corresponding stationary symbol relative to the pay-out line 24 is imperceptible with the naked eye. Although consecutive numbers can be allocated to the enabled stop positions, for the sake of clarity of the drawing, one is skipped between each pair of adjacent enabled stop positions in FIG. 2.

FIG. 2 shows further that six stop positions are enabled for the second field, two stop positions for the third field, one stop position for the nineteenth field, and seven stop positions for the twentieth field.

If for all twenty fields together 200 of the 10,000 possible positions are enabled as stop positions for the reel 10, the memory 31 contains a table with 200 memory locations, each containing one of the enabled stop positions. In this example, the random, generator means are then suitable for selecting a random number from 200 possible numbers and delivering that number to the memory 31 as the address for reading a stop position from the corresponding location of the abovementioned table.

As an alternative, the random generator means can have a range which is greater that the number of enabled stop positions (200 in the example), and the random number generated therefrom represents a number of steps by which an address for the table is increased modulo the number of enabled stop positions from the address belonging to the last standstill onwards. As a result, the random generator means do not have to be changed when the number of locations of the table is changed and/or the same random generator means can be used for several reels with identical or different numbers of enabled stop positions, which is in contrast with known machines.

When, during the rotation of the reel 10, the processor 30, using a generated random number, has read an enabled stop position from the table, the processor 30 controls the microstep drive circuit 21 to make the stepping motor 20 stop in this stop position. In order to ensure that no physical angle detection means are necessary, the processor 30 preferably remembers which the last stop position was, calculates the difference between this position and the read-out new position and controls the drive circuit 21 to make the motor 20 take a number of microsteps corresponding to the calculated difference between the stop positions.

The random generator means can be designed to generate a further random number which indicates a number of revolutions of the reel 10 which, after actuation of the stop command switch 34, the reel 10 first has to make before the motor 20 rotates to the stop position read from the table and is brought to a standstill there. The abovementioned number of revolutions can be detected by means of the flag 28 of the reel 10 and the optical bridge detector 29 which is linked to the processor 30.

After the reel 10 has been installed in the gaming machine, a marking point made on the reel, or the centre of a symbol placed in a field 12, can easily be aligned with a fixed mark, for example the pay-out line 24. For this purpose, the step command switch 35 can be actuated so often that the abovementioned marks appear to coincide to the eye. The number of steps or angle positions which at that moment have been taken since the flag 28 passed through the bridge 29 is subsequently always added as the offset to each read-out angle position, in order to deliver a calibrated read-out angle position. This means that, unlike previously, a laborious mechanical adjustment need not be carried out for the alignment, and additional mechanical means for that purpose can be omitted. Since the offset can be any value of the number of steps or possible angle positions, there is great freedom for applying a new tape with symbols to the reel 10, and the tape can be applied very quickly.

The data input device 32, which is present permanently or otherwise in the gaming machine, can be used for creating and amending the abovementioned table in the memory 31 with enabled stop positions.

It will be clear from the above that the gaming machine according to the invention can be substantially of universal design physically, and yet can still easily be adapted to specific wishes of customers, for example with a different chance distribution for prizes, by enabling more or fewer stop positions for the different fields and/or for changing the number of fields by applying another tape with symbols, without this having to be carried out relative to a specific reference point of the reel 10. Furthermore, the gaming machine according to the invention is simple and maintenance-friendly in particular as far as the mechanical design is concerned.

What is claimed is:

1. A gaming machine, comprising:

a reel of which a circumferential surface is divided in a number of fields which each bear a symbol from several symbols, which may include a blank;

drive means for rotating the reel;

memory means for storing data representing allowed rotational stop positions of the reel where the reel is allowed to stop, the number of allowed stop positions being greater than said number of fields;

random number generator means for randomly generating an address of a location of said memory means containing data representing an allowed stop position; and stop means for controlling the drive means to stop rotation of the reel opposite a winning line at a rotational stop position which corresponds to said randomly generated memory means address;

wherein adjacent rotational stop positions are less than 0,1° apart from each other and for each field all allowed stop positions are located within an arc of 2°.

2. A gaming machine according to a claim 1, wherein for each field all allowed stop positions are located within a circumferential length of the reel which equals the width of the winning line.

3. A gaming machine according to claim 1, wherein the random number generator means have a number range which is greater than the number of allowed stop positions and the address provided by the generator means is obtained by summing a random number to a previously provided address and taking the sum modulo the number of allowed stop positions.

4. A gaming machine according to claim 1, wherein the drive means comprise a stepper motor, and command means are provided for controlling the drive means in such a way that, during a calibration step, the reel is moved stepwise through an angle between a fixed reference point provided on the reel and a machine specific marking point provided on the reel to determine the number of stop positions passed along a stationary marking point, and in which after the calibration step said number is added as offset value to a data representing an allowed stop position read from an address provided by the random generator means.

* * * * *